US008182323B2

(12) United States Patent
Okada

(10) Patent No.: US 8,182,323 B2
(45) Date of Patent: May 22, 2012

(54) GAMING METHOD AND GAMING MACHINE ACCEPTING SIDE BET

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 1239 days.

(21) Appl. No.: 11/928,525

(22) Filed: Oct. 30, 2007

(65) Prior Publication Data

US 2008/0220835 A1 Sep. 11, 2008

Related U.S. Application Data

(60) Provisional application No. 60/905,050, filed on Mar. 6, 2007.

(51) Int. Cl.
*A63F 9/24* (2006.01)

(52) U.S. Cl. ..... 463/13

(58) Field of Classification Search ..... 463/13; 273/292, 274

See application file for complete search history.

(56) References Cited

U.S. PATENT DOCUMENTS 5,711,525 A 1/1998 Breeding
6,789,801 B2 9/2004 Snow
6,811,153 B1 * 11/2004 Ko ..... 273/292
6,874,786 B2 4/2005 Bruno et al.

* cited by examiner

*Primary Examiner* — Corbett B Coburn
(74) *Attorney, Agent, or Firm* — Lexyoume IP Group, PLLC.

(57) ABSTRACT

In a playing method of a card game, a predetermined number of cards are dealt to a player as player's cards, a predetermined number of cards are dealt to a banker as banker's cards, and a side BET different from a normal BET is placed. A result of a game is determined by comparing a hand of the player's cards with a hand of the banker's cards, when the banker should not fold. It is determined whether or not the banker should fold following a rule different from a previous rule on condition that the side BET is placed, when the banker should fold, and the result of the game is determined by comparing the hand of the player's cards with the hand of the banker's cards, when the banker should not fold.

8 Claims, 7 Drawing Sheets

GAMING METHOD AND GAMING MACHINE ACCEPTING SIDE BET

CROSS-REFERENCE TO RELATED APPLICATIONS

This application claims benefit of priority based on U.S. Provisional Patent Application No. 60/905,050 filed on Mar. 6, 2007. The contents of this application are incorporated herein by reference in their entirety.

BACKGROUND OF THE INVENTION

Field of the Invention

The present invention relates to a gaming method and a gaming machine accepting side BETs.

DISCUSSION OF THE BACKGROUND

Conventionally, there have been gaming machines capable of accepting side BETs different from normal BETs. For example, in blackjack, when an upcard is an "A" card out of dealer's two cards, a player can place a side BET called insurance, in addition to a normal BET. In a case of placing insurance, the player adds the wager by half of an initial wager. When the dealer's hand is "Natural 21", the amount twice the value of the side BET (insurance) is paid out. Further, for example, in CARIBBEAN STUD poker, a side BET is cumulatively accumulated as a progressive jackpot. When a player places a side BET in addition to an ante (a normal BET), he or she can acquire a part of or the entire progressive jackpot, according to the established hand. A game capable of accepting side BETs of this kind is disclosed in, for example, U.S. Pat. Nos. 6,789,801, 5,711,525 and 6,874,786.

It is an object of the present invention to provide a gaming method and a gaming machine capable of accepting side BETs, thus exhibiting new entertainment.

The contents of U.S. Pat. Nos. 6,789,801, 5,711,525 and 6,874,786 are incorporated herein by reference in their entirety.

SUMMARY OF THE INVENTION

According to the present invention, there is provided a playing method of a card game having the following structure.

Namely, the above mentioned playing method of a card game is a playing method of a card game comprising the steps of: (a) dealing a predetermined number of cards to a player as player's cards and dealing a predetermined number of cards to a banker as banker's cards; (b) placing a side BET different from a normal BET; (c) determining whether or not the banker should fold; (d) determining a result of a game by comparing a hand of the player's cards with a hand of the banker's cards, when determining that the banker should not fold in the step (c); (e) determining whether or not the banker should fold following a rule different from a rule in the step (c), on condition that the side BET is placed, when determining that the banker should fold in the processing (c); and (f) determining the result of the game by comparing the hand of the player's cards with the hand of the banker's cards, when determining that the banker should not fold in the step (e).

Further, it is preferable that the playing method of a card game according to the present invention have the following structure.

The step (c) comprises the steps of: (c-1) determining whether or not the strength of the banker's cards is lower than a standard predetermined in an order of the hand strength; and (c-2) determining that the banker should fold, when determining that the strength of the banker's cards is lower than the standard, and the step (e) comprises the steps of: (e-1) lowering the standard determined in the order of the hand strength, on condition that the side BET is placed, when determining that the banker should fold in the step (c); (e-2) determining whether or not the strength of the banker's cards is equal to or higher than the lowered standard; (e-3) determining that the banker should not fold, when determining that the strength of the banker's cards is equal to or higher than the lowered standard.

Further, it is preferable that the playing method of a card game according to the present invention have the following structure.

The above mentioned playing method of a card game is a playing method of a card game comprising the steps of: (a') placing an entry-fee BET before the step (a); and (c') offering a payout based on the inputted entry-fee BET, on condition that the side BET is not placed, when determining that the banker should fold in the step (c).

Further, it is preferable that the playing method of a card game according to the present invention have the following structure.

The above mentioned playing method of a card game is a playing method of a card game comprising the steps of: (f') determining a payout based on the inputted side BET, when determining that the banker should fold in the step (e); (f") determining a payout based on the inputted side BET and the result of the game, when the result of the game determined in the step (f) is winning of the player.

Further, there is provided a gaming machine having the following structures according to the present invention.

Namely, the above mentioned gaming machine is a gaming machine comprising: a display capable of displaying a plurality of cards; an input device; and a controller. The controller is programmed to conduct the processing of: (a) displaying a predetermined number of player's cards and a predetermined number of banker's cards to the display; (b) accepting an input of side BET different from a normal BET from the input device; (c) determining whether or not the banker should fold; (d) determining a result of a game by comparing a hand of the player's cards with a hand of the banker's cards, when determining that the banker should not fold in the processing (c); (e) determining whether or not the banker should fold following a rule different from a rule in the processing (c), on condition that the side BET is placed, when determining that the banker should fold in said processing (c); (f) determining the result of the game by comparing the hand of the player's cards with the hand of the banker's cards, when determining that the banker should not fold in the processing (e).

Further, it is preferable that the gaming machine of the present invention have the following structure.

The processing (c) comprises processing of: (c-1) determining whether or not the strength of the banker's cards is lower than a standard predetermined in an order of the hand strength; and (c-2) determining that the banker should fold, when determining that the strength of the banker's cards is lower than the standard, and the processing (e) comprises processing of: (e-1) lowering the standard determined in the order of the hand strength, on condition that the side BET is placed, when determining that the banker should fold in the processing (c); (e-2) determining whether or not the strength of the banker's cards is equal to or higher than the lowered standard; and (e-3) determining that the banker should not fold, when determining that the strength of the banker's cards is equal to or higher than the lowered standard.

Further, it is preferable that the gaming machine of the present invention have the following structure.

The controller is further programmed to conduct the processing of: (a') accepting an input of an entry-fee BET from the input device before the processing (a); and (c') offering a payout based on the inputted entry-fee BET, on condition that the side BET is not placed, when determining that the banker should fold in the processing (c).

Further, it is preferable that the gaming machine of the present invention have the following structure.

The controller is further programmed to conduct the processing of: (f') determining a payout based on the inputted side BET, when determining that the banker should fold in the processing (e); (f'') determining a payout based on the inputted side BET and the result of the game, when the result of the game determined in the processing (f) is winning of the player.

DESCRIPTION OF THE EMBODIMENTS

Figure 1:
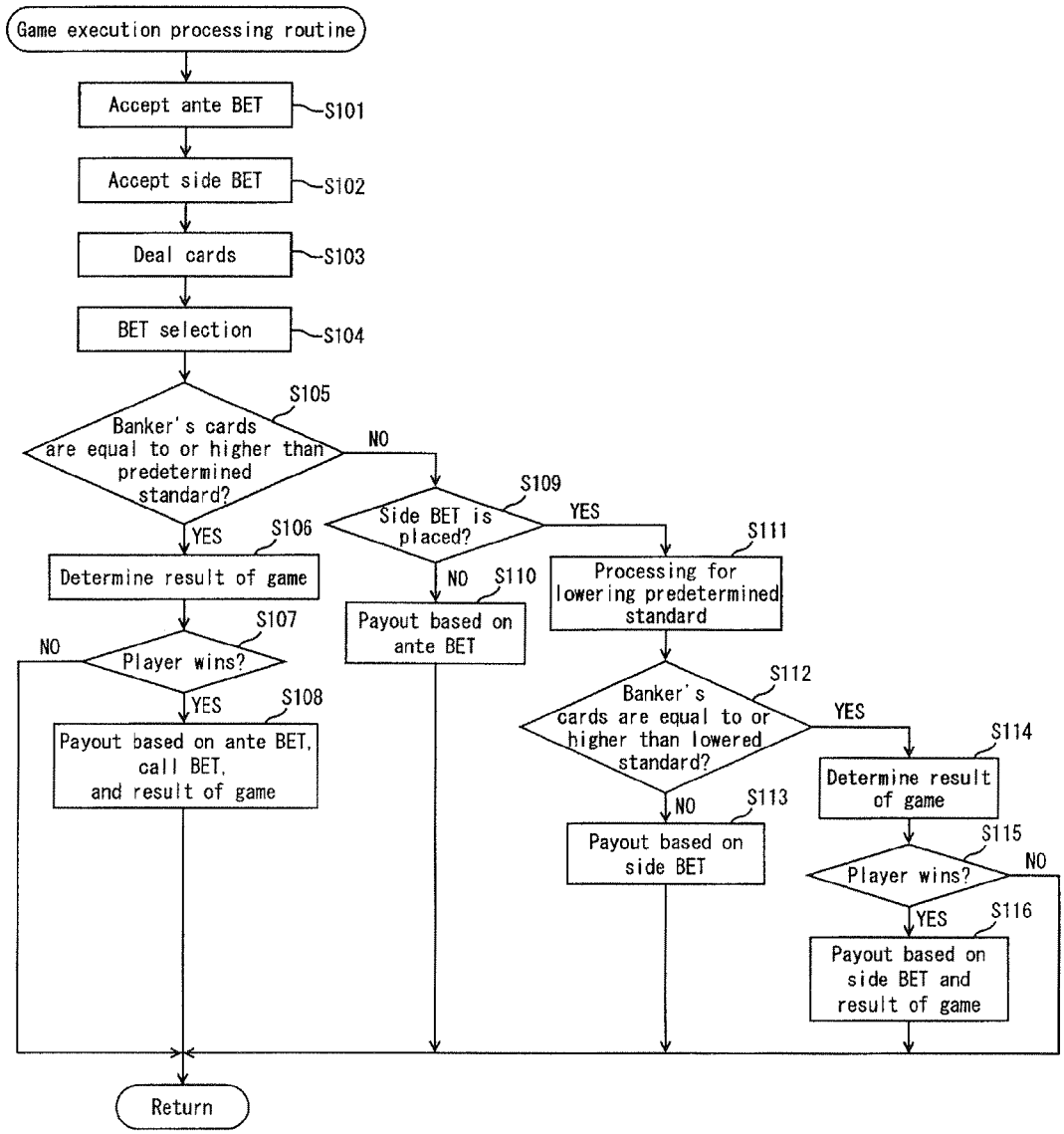
FIG. 1 is a flow chart illustrating a game execution processing routine conducted in a gaming machine according to one embodiment of the present invention.

There will be described an embodiment of the present invention with regard to the case where CARIBBEAN STUD poker is played as a card game. First, the rule of CARIBBEAN STUD poker, which is played in the present embodiment, will be described.

In CARIBBEAN STUD poker, a banker, and a single player or a plurality of players play a game against each other, using a single set of playing cards (52 cards). Winning or losing of a game is determined by comparing the hand of five cards dealt to the banker with the hand of five cards dealt to the player to determine which of them is stronger than the other. As hands of CARIBBEAN STUD poker, hands of poker are employed. Namely, as hands of CARIBBEAN STUD poker, there are Royal Flush, Straight Flush, Four of a Kind, Full House, Flush, Straight, Three of a Kind, Two pair, One pair and No Pair, in the order of strength. The strength of a hand "No pair" is determined depending on the strength of a high card therein. The high card is the highest card in the strength ranking of cards among the five cards. As the strength ranking of cards, an ace is the highest, followed by K, Q, j, 10 . . . 2, in descending order. When two hands are equal in the strength of the high cards, the stronger hand of the two is determined based on the strength of the second highest cards in the strength ranking of cards. Hereinafter, the strength ranking of hands is predetermined following the same procedure. This strength ranking of hands corresponds to the order of the hand strength according to the present invention.

More specifically, a game progresses as follows. First, an ante BET and a side BET are accepted. Then, five cards are dealt to each player who has placed an ante BET and the banker. The ante BET corresponds to an entry-fee BET according to the present invention. Each player selects either of the actions to take, "surrender" or "call bet", on seeing the cards dealt to him or her. Selecting "surrender" indicates that the player passes the game without playing against the banker. When selecting "surrender", the player loses an amount corresponding to the ante BET and the side BET. On the other hand, selecting "call bet" indicates that the player plays the game against the banker. When selecting "call bet", the player newly bets the value twice the value of the ante BET, as a call BET. Hereinafter, selecting either of "surrender" or "call bet" by the player will be referred to as a BET selection. When the BET selections by all the players in the game finish, whether or not the game between the banker and the players should be played, is determined following the below-mentioned procedure.

First, when a strength of the banker's hand is lower than the strength of "A-K-*-*-*", the banker passes the game as he or she can not start the game against the player. Here, "A-K-*-*-*" indicates a combination of five cards, wherein "*" may indicate any card. However, "A-K-*-*-*" as a standard to determine whether or not the banker should pass the game, may not be a combination which forms a hand equal to or stronger than One Pair. Namely, a hand having a strength lower than the strength of "A-K-*-*-*" refers to a hand having a strength equal to or lower than the strength of "A-Q-J-10-9". Further, the banker's passing the game as described above corresponds to "fold" according to the present invention. Hereinafter, also in the present embodiment, the banker's passing the game following the above-mentioned procedure will be referred to as "fold". Further, "A-K-*-*-*" corresponds to a standard predetermined in the order of the hand strength according to the present invention. When the banker folds, the player newly acquires the value corresponding to the ante BET, on condition that no side BET is placed. However, the call BET becomes invalid and the betted amount is paid back in its entirety.

On the other hand, when a strength of the banker's hand is equal to or higher than the strength of "A-K-*-*-*", a game between the banker and the player is executed. The result of winning or losing of the game is determined by comparing the banker's hand with the player's hand, based on the above-mentioned strength ranking of hands in poker. When winning or losing of the game results in winning of the player, a payout is offered based on the value of the ante BET and the call BET, and the result of the game. Here, the payout for the ante BET is the same value as the value of the ante BET. On the other hand, for the payout for the call BET, rates are predetermined in accordance with the strength of hands. The predetermined rates are as follows. Namely, the rate is one to one on One Pair. The rate is two to one on Two Pair. The rate is three to one on Three of a Kind. The rate is four to one on Straight. The rate is five to one on Flush. The rate is seven to one on Full House. The rate is twenty to one on Four of a Kind. The rate is fifty to one on Straight Flush. The rate is 100 to one on Royal Flush.

When winning or losing of the game results in a loss of the player, the player loses the value corresponding to the ante BET and the call BET.

There has been described the general rule of CARIBBEAN STUD poker. In the present embodiment, the following procedure is further employed, on condition that a side BET is placed, when the banker folds. First, the standard of the hand strength for determining whether or not the banker should fold, is changed to the standard lower than the strength of "A-K-*-*-*". Hereinafter, the standard before changing will be referred to as an original standard. Further, the standard after changing will be referred to as a lowered standard. Whether or not the banker should fold is determined based on the lowered standard. Further, the game progresses in the same manner as described above.

Namely, when the strength of the banker's hand is lower than the lowered standard, the banker passes the game. Then, the player newly acquires the value corresponding to the side BET.

On the other hand, when the strength of the banker's hand is equal to or higher than the lowered standard, the banker and the player play a game against each other. The result of winning or losing of the game is determined by comparing the banker's hand with the player's hand, based on the above-mentioned strength ranking of hands in poker. When winning or losing of the game results in winning of the player, the payout is offered based on the value of the side BET and the result of the game. The payout is offered based on the above-mentioned rates predetermined in accordance with the strengths of hands. When winning or losing of the game results in a loss of the player, the player loses the value corresponding to the side BET.

Further, when the banker folds based on the original standard, the ante BET and the call BET are handled in the same manner as in the case where no side BET is placed, even when a side BET is placed. Namely, the player newly acquires the value corresponding to the ante BET, but the call BET is invalid and the betted value is paid back in its entirety.

There has been described the rule of CARIBBEAN STUD poker executed in the present embodiment. Hereinafter, the present embodiment will be described with reference to the drawings. Further, in each embodiment, there will be described a case where a dealer serves as a banker.

First, the present invention will be described with reference to FIG. 1.

FIG. 1 is a flow chart illustrating a game execution processing routine conducted in a gaming machine according to an embodiment of the present invention.

The gaming machine according to the present embodiment comprises a main control portion and a plurality of stations, and each station includes a microcomputer. The above-mentioned main control portion and the above-mentioned microcomputer form a controller included in the gaming machine of the present invention. The processing illustrated in FIG. 1 is processing conducted by the above-mentioned main control portion and the above-mentioned microcomputer.

First, at each station included in the gaming machine, inputs of an ante BET and a side BET are accepted (step S101 and S102). Then, five cards are dealt to each player who has inputted an ante BET and the banker (step S103). Here, the term "dealing" refers to displaying images of cards to a display included in the gaming machine. After the dealing of cards, each player conducts an above-described BET selection (step S104). When BET selections by all players in the game finish, the main control portion included in the gaming machine determines whether or not the hand strength of the banker's cards is equal to or higher than the strength of "A-K-*-*-*" (step S105). When the hand strength of the banker's cards is equal to or higher than the strength of "A-K-*-*-*", the main control portion determines the result of the game by comparing the banker's cards with the player's cards (step S106). When the game results in winning of the player, the main control portion offers a payout to the player based on the ante BET, the call BET, and the result of the game (steps S107 and S108). When the hand strength of the banker's cards is lower than the strength of "A-K-*-*-*" and no side BET is placed (step S105 and S109), the main control portion offers a payout to the player based on the ante BET only (step S110).

When the hand strength of the banker's cards is lower than the strength of "A-K-*-*-*" and a side BET is placed (steps S105 and S109), the main control portion changes the standard for determining whether or not the banker should fold, to the standard lower than the strength of "A-K-*-*-*" (step S111). Then, the main control portion determines whether or not the hand strength of the banker's cards is equal to or higher than the lowered standard (step S112). When the hand strength of the banker's cards is lower than the lowered standard, the main control portion offers a payout to the player based on the side BET only (step S113). When the hand strength of the banker's cards is equal to or higher than the lowered standard, the main control portion determines the result of the game by comparing the banker's cards with the player's cards (step S114). When the game results in winning of the player, the main control portion offers a payout to the player based on the side BET and the result of the game (steps S115 and S116).

FIG. 1 will be described in more detail later again.

Next, there will be described the gaming machine 1 according to the present embodiment.

Figure 2:
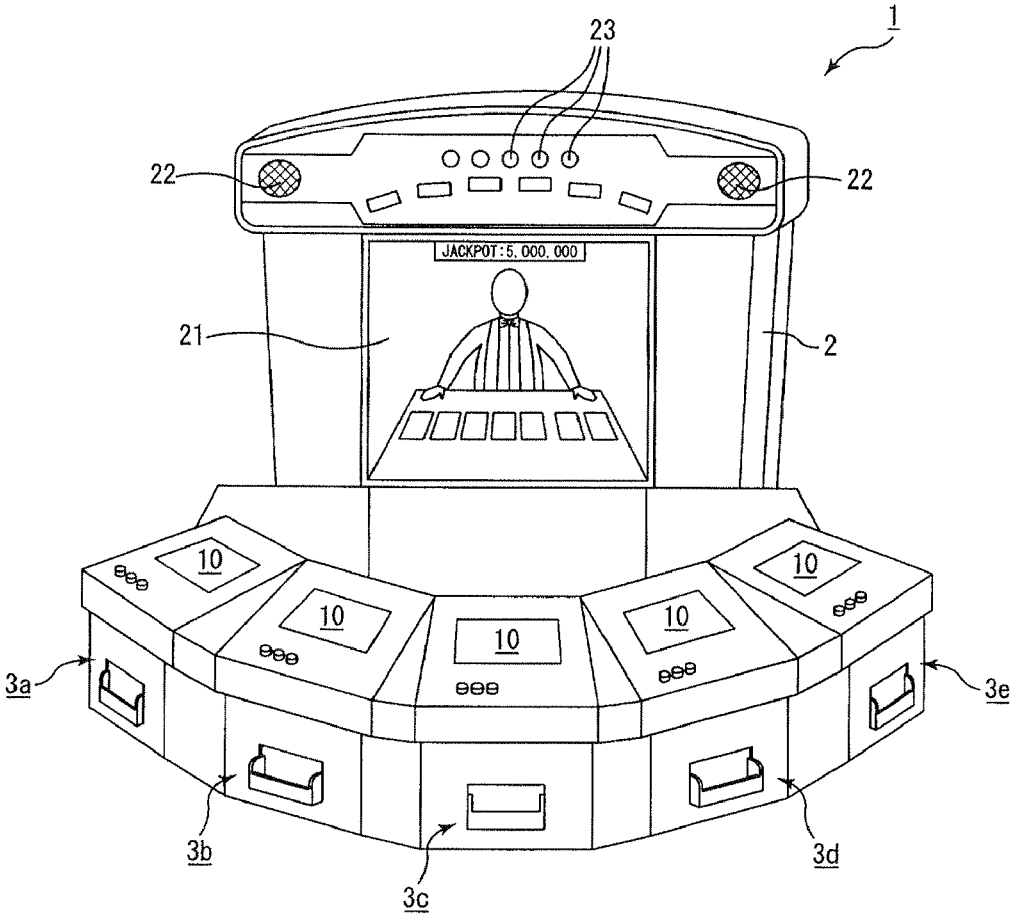
FIG. 2 is a perspective view schematically illustrating the external structure of the gaming machine according to the present embodiment.

FIG. 2 is a perspective view schematically illustrating the external structure of the gaming machine according to the present embodiment.

As illustrated in FIG. 2, the gaming machine 1 is basically comprised of a main monitor 2 and five stations 3 (stations 3*a* to 3*e*). Further, while, in the present embodiment, there will be described a case where the gaming machine 1 comprises a plurality of (five) stations 3, the number of stations included in a gaming machine may be one, in the present invention.

At the center portion of the main monitor 2, there is provided a front display 21 for displaying images indicating a dealer and cards. The front display 21 corresponds to a display according to the present invention. Further, on the upper side of the main monitor 2, there are provided a plurality of speakers 22 for outputting music and an effect sound along with the progression of a game executed in the gaming machine 1 and a plurality of LEDs 23 which are lighted during various types of effects.

Figure 3:
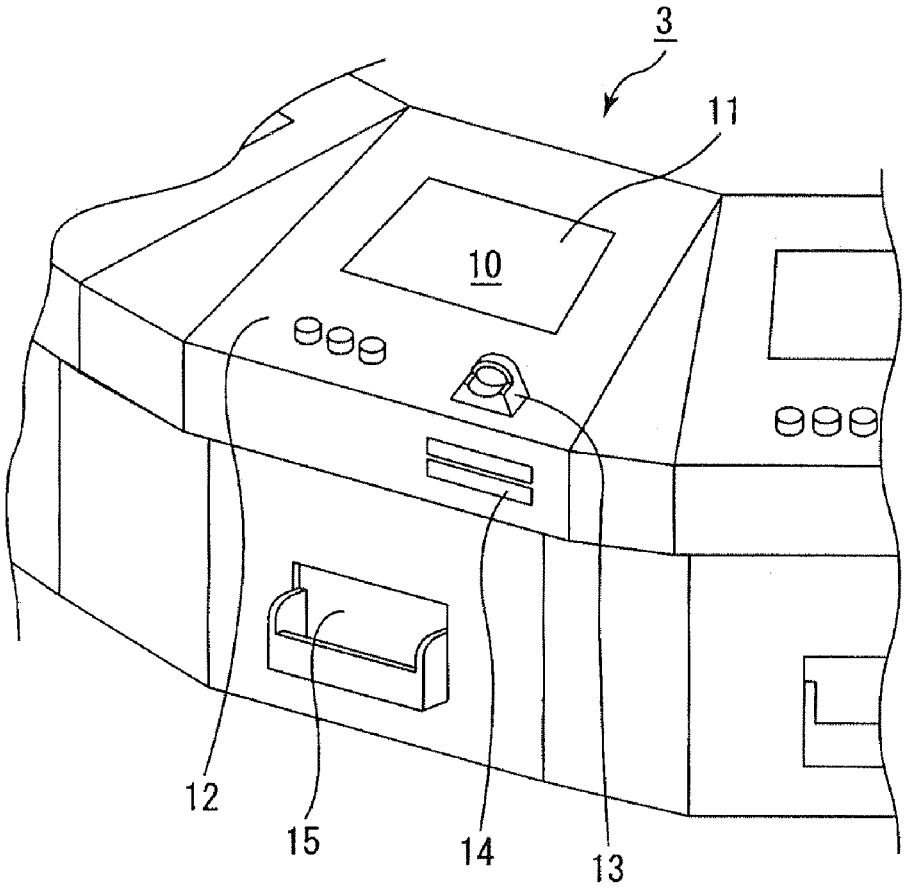
FIG. 3 is a perspective view schematically illustrating the external structure of a station included in the gaming machine illustrated in FIG. 2.

FIG. 3 is a perspective view schematically illustrating the external structure of a station included in the gaming machine illustrated in FIG. 2.

As illustrated in FIG. 3, at the center of the upper surface of the station 3, there is provided a liquid crystal display 10 for displaying an image relating to an operation (see FIG. 5) and the like as will be described later. The liquid crystal display 10 corresponds to a display according to the present invention. Further, on the upper surface of the liquid crystal display 10, there is provided a touch panel 11 for inputting an operation for a BET and the like. The touch panel 11 corresponds to an input device according to the present invention.

In front of the liquid crystal display 10, there are provided a plurality of operation buttons 12 for performing a payout operation, and a coin insertion slot 13 for inserting a coin or a medal thereto.

At the right end of the upper portion of the front surface of the station 3, there is provided a bill insertion slot 14 for inserting a bill thereto. Below the bill insertion slot 14, there is provided a coin payout exit 15 for paying out the number of coins or medals corresponding to the accumulated credit to the player, when a payout operation is performed.

Figure 4:
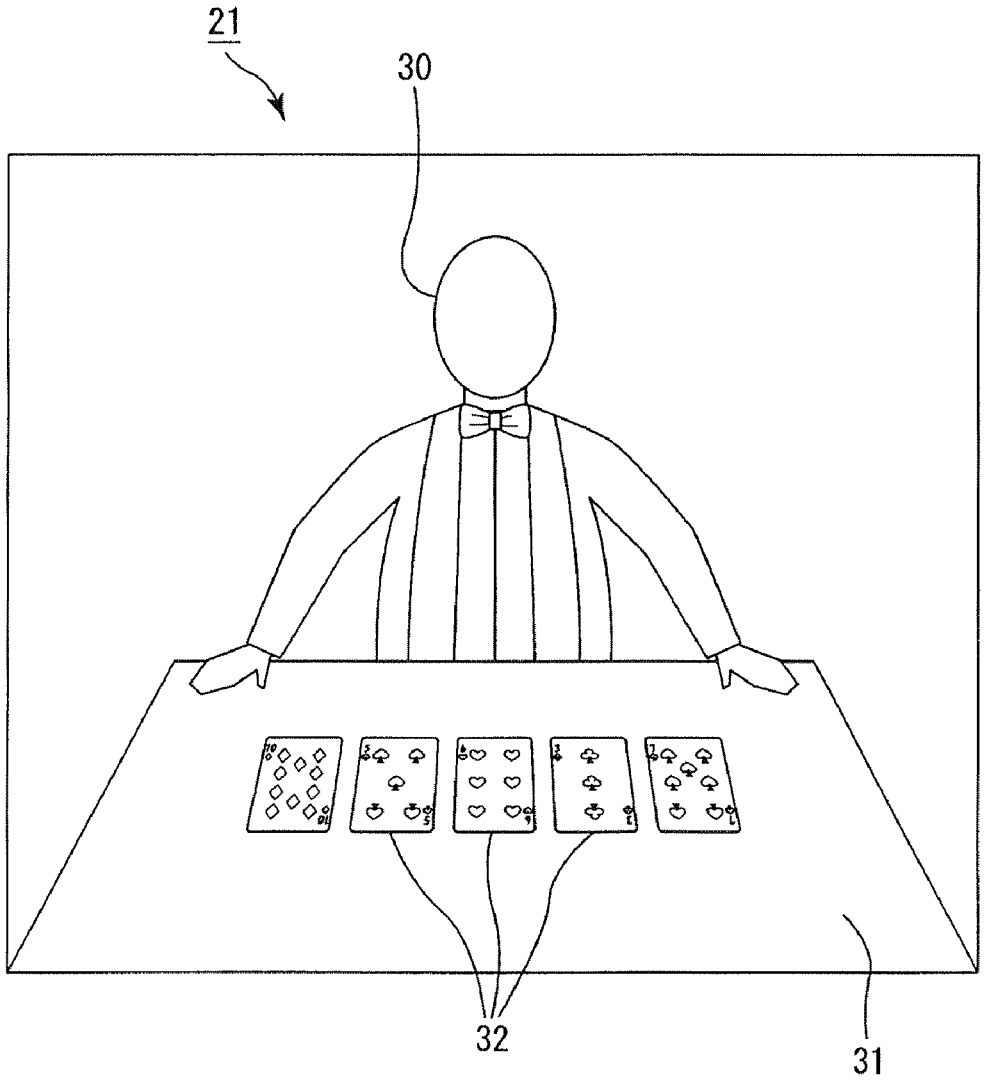
FIG. 4 is a view illustrating an exemplary image which is displayed to a front display included in the gaming machine.

FIG. 4 is a view illustrating an exemplary image which is displayed to the front display included in a gaming machine.

As illustrated in FIG. 4, the front display 21 displays a dealer image 30 indicating a dealer (banker), a table image 31 indicating a table, and card images 32 indicating banker's cards. All the card images 32 are displayed facing down, when cards are dealt to the dealer. When BET selections by all the players in the game finish, the card images 32 are displayed facing up.

Figure 5:
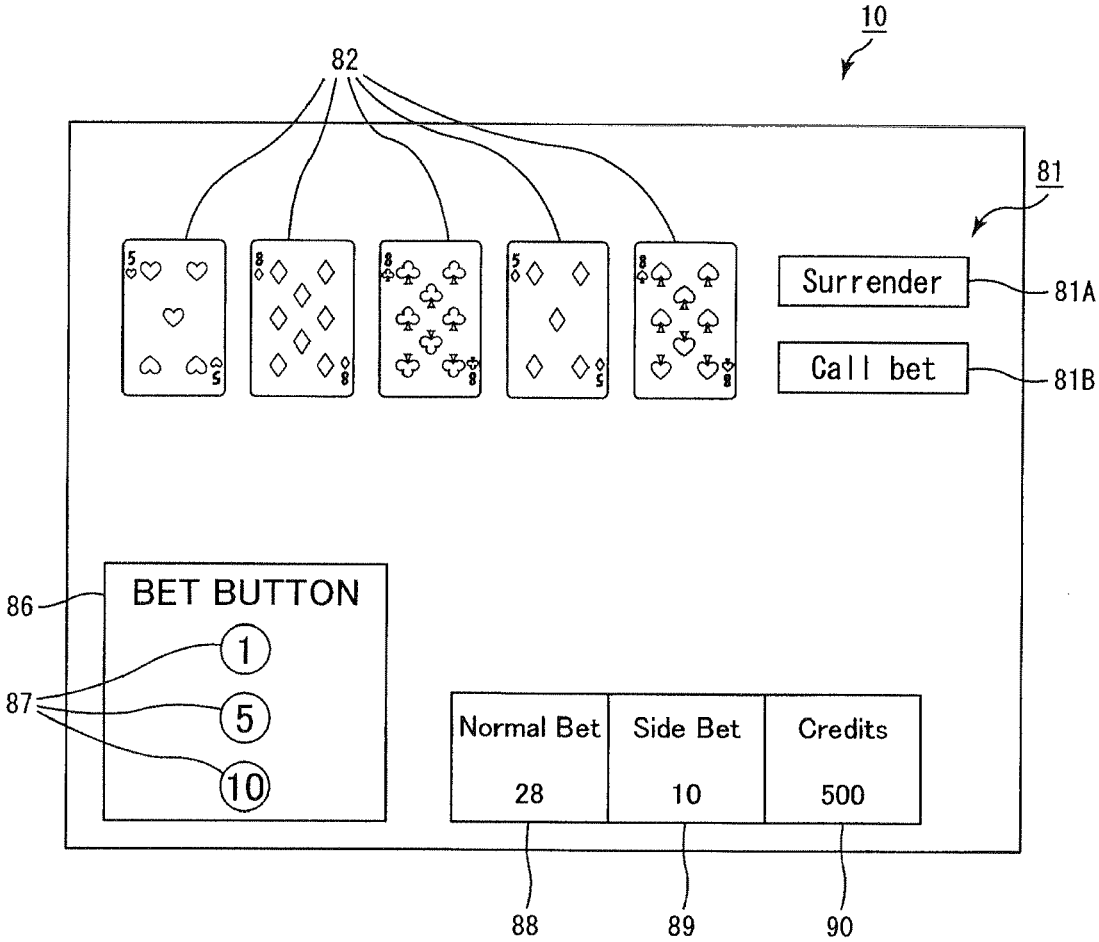
FIG. 5 is a view illustrating an exemplary image which is displayed to a liquid crystal display included in a station.

FIG. 5 is a view illustrating an exemplary image which is displayed to a liquid crystal display included in a station.

As illustrated in FIG. 5, at the right side of the upper portion of the liquid crystal display 10, there are provided BET selection buttons 81. The BET selection buttons 81 comprises 2 kinds of buttons, surrender button 81A and call-bet button 81B. Surrender button 81A is a button for inputting a command to select "surrender" as a BET selection. Call-bet button 81B is a button for inputting a command to select "call bet" as a BET selection. The player can conduct a BET selection by operating each button through touch panel 11. At the left side of BET selection buttons 81, there are displayed card images 82 indicating the player's cards with their faces up.

Under the card images 82, there is provided a BET button display portion 86. To the BET button display portion 86, there are displayed BET buttons 87 for inputting the number of BETs. The player can input the number of normal BETs and the number of side BETs by operating the BET buttons 87 through the touch panel 11.

At the right side of the BET button display portion 86, there is provided a number-of-normal-BETs display portion 88 for displaying the number of coins being betted as a normal BET. FIG. 5 illustrates that 28 coins are betted. Further, in order to input a BET of 28 coins, the player can operate a "10" BET button 87 twice, "5" BET button 87 once and a "1" BET button 87 three times.

At the right side of the number-of-normal-BETs display portion 88, there is provided a number-of-side-BETs display portion 89 for displaying the number of coins betted as a side BET. FIG. 5 illustrates that 10 coins are betted.

At the right side of the number-of-side-BETs display portion 89, there is provided the number-of-credits display portion 90. FIG. 5 illustrates that 500 coins are being credited.

Figure 6:
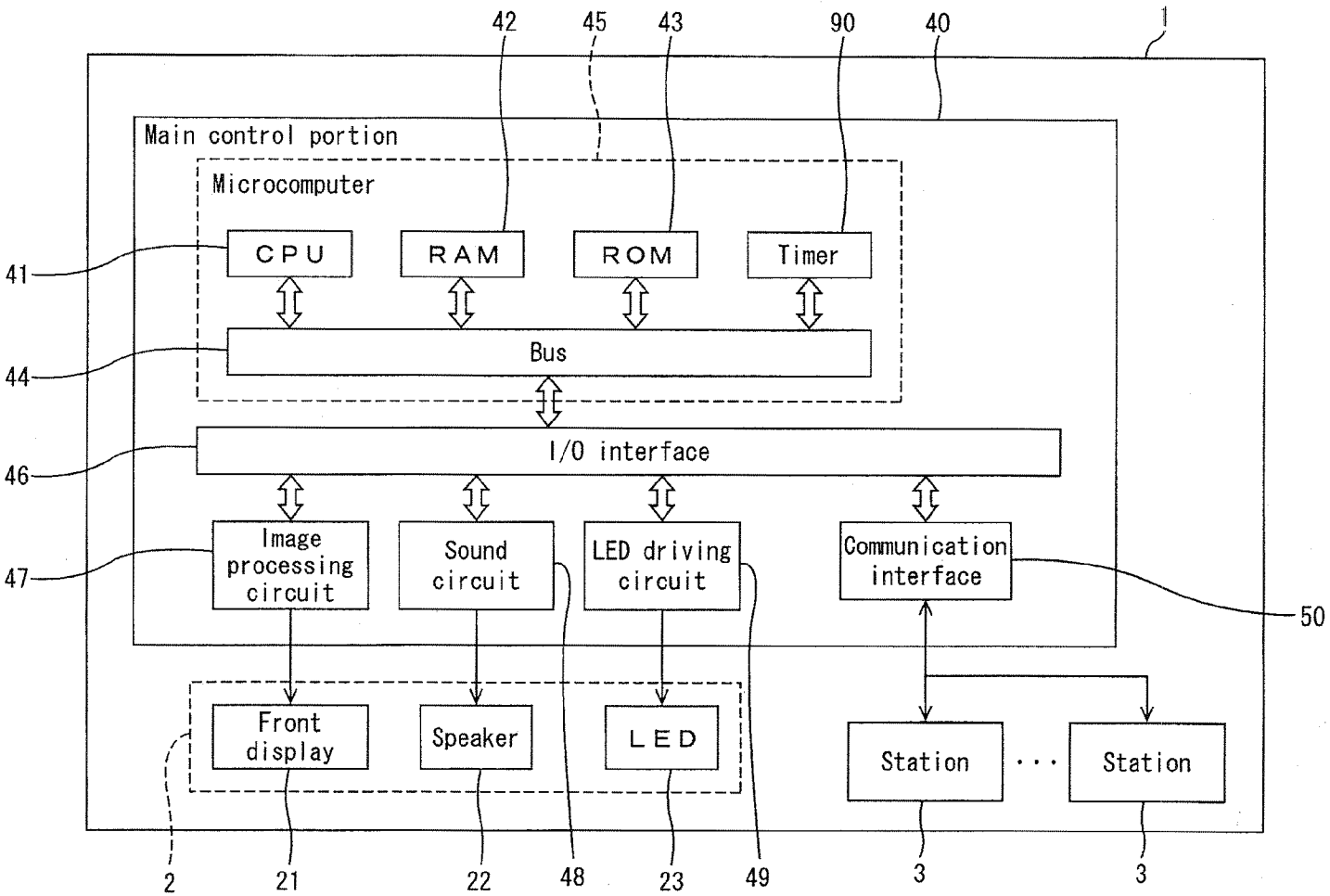
FIG. 6 is a block diagram illustrating the internal structure of the gaming machine illustrated in FIG. 2.

FIG. 6 is a block diagram illustrating the internal structure of the gaming machine illustrated in FIG. 2.

As illustrated in FIG. 6, the main control portion 40 provided in the gaming machine 1 comprises a microcomputer 45 as the core, which basically includes a CPU 41, a RAM 42, a ROM 43, a timer 95, and a bus 44 for transferring data mutually among these devices. The main control portion 40 corresponds to a controller according to the present invention.

The ROM 43 stores various types of programs for conducting processing necessary for controlling the gaming machine 1, a data table and the like. The RAM 42 is a memory for temporarily storing various types of data calculated in the CPU 41. Further, the timer 95 conducts time measurement.

Further, the CPU 41 is connected to an image processing circuit 47, a sound circuit 48, an LED driving circuit 49 and a communication interface 50 through an I/O interface 46.

The front display 21 included in the main monitor 2 is connected to the image processing circuit 47. The plurality of speakers 22 included in the main monitor 2 are connected to the sound circuit 48. The LEDs 23 included in the main monitor 2 are connected to the LED driving circuit 49. The five stations 3 are connected to the communication interface 50.

The CPU 41 progresses a game (CARIBBEAN STUD poker) which is executed in the gaming machine 1, based on game programs (including a game program for CARIBBEAN STUD poker) stored in the ROM 43 and various types of signals received from the stations 3. Further, the CPU 41 displays an image to the front display 21, outputs sound from the plurality of speakers 22 and lights the LEDs 23, based on the above-mentioned game programs. Further, the CPU 41 transmits various types of signals to the respective stations 3, based on the above-mentioned game programs.

Figure 7:
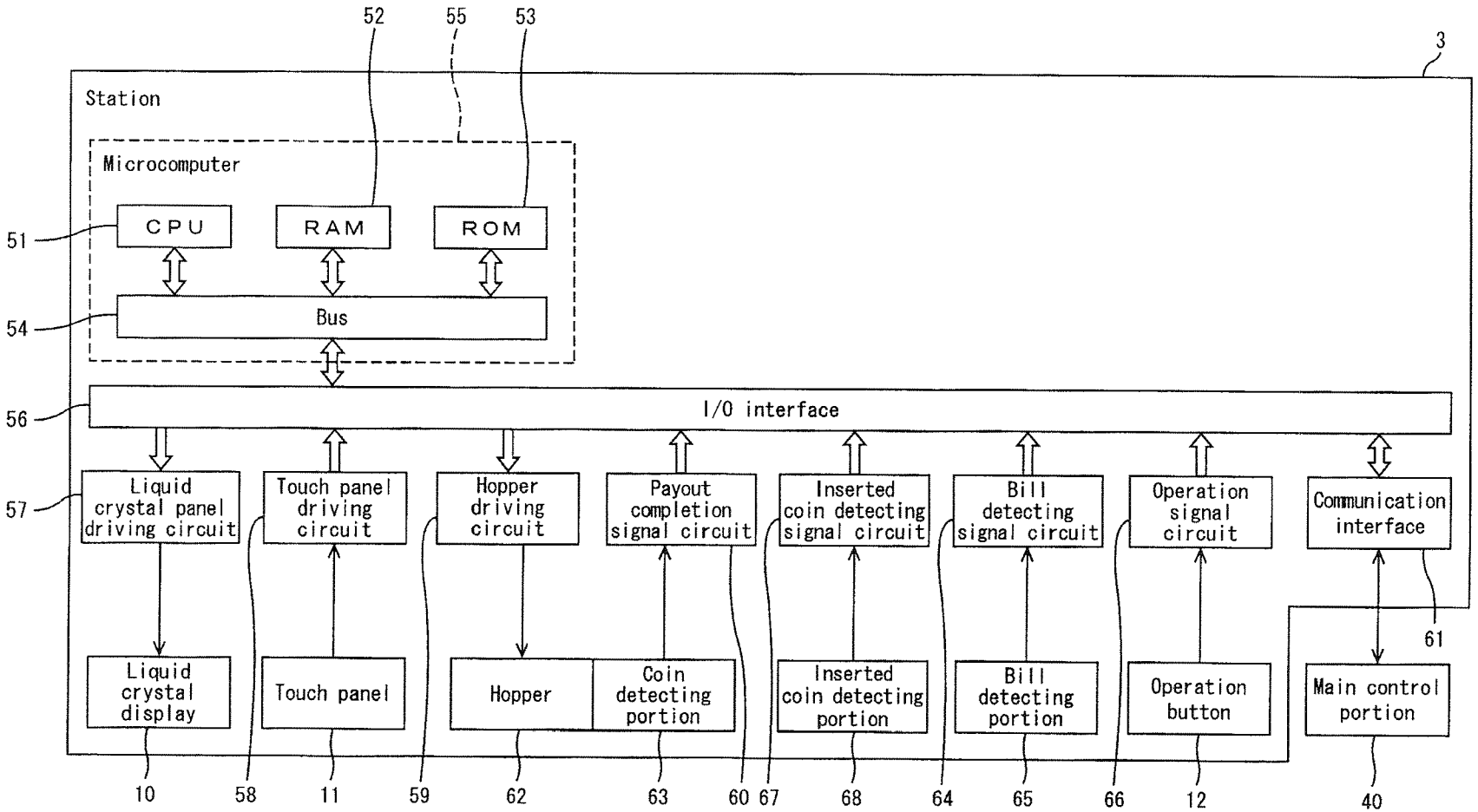
FIG. 7 is a block diagram illustrating the internal structure of a station included in the gaming machine illustrated in FIG. 2.

FIG. 7 is a block diagram illustrating the internal structure of a station included in the gaming machine illustrated in FIG. 2.

As illustrated in FIG. 7, the station 3 includes, as the core, a microcomputer 55 which is basically comprised of a CPU 51, a RAM 52, a ROM 53, and a bus 54 for transferring data mutually among these devices.

The ROM 53 stores various types of programs for conducting processing necessary for controlling the station 3, data tables and the like. Further, the RM 52 temporarily stores the number of credits currently accumulated in the station 3 and various types of data calculated in the CPU 51.

Further, the CPU 51 is connected to a liquid crystal panel driving circuit 57, a touch panel driving circuit 58, a hopper driving circuit 59, a payout completion signal circuit 60, an inserted-coin detecting signal circuit 67, a bill detecting signal circuit 64, an operation signal circuit 66 and a communication interface 61, through an I/O interface 56.

A liquid crystal display 10 is connected to the liquid crystal panel driving circuit 57. A touch panel 11 is connected to the touch panel driving circuit 58. A hopper 62 is connected to the hopper driving circuit 59. A coin detecting portion 63 is connected to the payout completion signal circuit 60. An inserted-coin detecting portion 68 is connected to the inserted-coin detecting signal circuit 67. A bill detecting portion 65 is connected to the bill detecting signal circuit 64. An operation button 12 is connected to the operation signal circuit 66.

The hopper 62 is provided inside the station 3 and pays out a coin through the coin payout exit 15 based on a control signal outputted from the CPU 51.

The coin detecting portion 63 is provided inside the coin payout exit 15 and transmits a signal to the CPU 51 on detecting a predetermined number of coins being paid out through the coin payout exit 15.

The inserted-coin detecting portion 68, on detecting a coin being inserted from the coin insertion slot 13, detects the value of the coin and transmits a detecting signal indicative of the detected value to the CPU 51. The detected value of the coin is counted regarding a predetermined value defined as 1 credit and is stored in the RAM 52.

The bill detecting portion 65, on accepting a bill, detects the value of the bill and transmits a detecting signal indicative of the detected value to the CPU 51. The detected value of the bill is counted regarding a predetermined value defined as 1 credit and is stored in the RAM 52.

The operation button 12 is a button for performing payout operations, when payout of the coin is determined.

Next, there will be described processing conducted in the gaming machine 1.

FIG. 1 is a flow chart illustrating a game execution processing routine conducted in the gaming machine according to the embodiment of the present invention.

First, in step S101 in FIG. 1, the gaming machine 1 conducts processing relating to the acceptance of the ante BET. More specifically, at first, the CPU 51 in the station 3 accepts an input of an ante BET. This enables the player to input an ante BET through the touch panel 11 included in the station 3. Then, the CPU 51 transmits ante-BET information to the main control portion 40. The ante-BET information is information relates to the ante BET and includes information about whether or not an ante BET is placed and the value of the ante BET. The ante BET is included in normal BET according to the present invention.

Next, in step S102, the gaming machine 1 conducts the processing relating to the acceptance of a side BET. More specifically, first, the CPU 51 in the station 3 accepts an input of the side BET. This enables the player to input the side BET through the touch panel 11 included in the station 3. Then, the CPU 51 transmits side BET information to the main control portion 40. The side BET information is information relating to the side BET and including information about whether or not the side BET is placed and the value of the side BET. The processing conducted by the main control portion 40 and the microcomputer 55 in the station 3 in step S102 corresponds to step (b) placing a side BET different from a normal BET, according to the present invention.

Next, in step S103, the gaming machine 1 conducts processing relating to the dealing of cards to the player and the banker. More specifically, the CPU 41 in the main control portion 40 determines five cards to be dealt to each player and the banker, out of a single set of playing cards, using random numbers. The five cards determined to be dealt to the player correspond to player's cards according to the present invention, while the five cards determined to be dealt to the banker correspond to banker's cards according to the present invention. Further, card images indicative of the five banker's cards are displayed facing down to the front display 21 included in the gaming machine 1. Subsequently, the CPU 41 transmits to-be-dealt cards information to the station 3. The to-be-dealt cards information includes information indicative of the types of the cards determined to be dealt to the player and the banker (ranks and suits [heart, club, spade, diamond]). The CPU 51 in the station 3 displays card images indicative of the five player's cards to a liquid crystal display 10, based on the received to-be-dealt cards information.

The processing conducted by the main control portion 40 and the microcomputer 55 in the station 3 in step S103 corresponds to step (a) dealing a predetermined number of cards to a player as player's cards and dealing a predetermined number of cards to a banker as banker's cards, according to the present invention.

Next, in step S104, the gaming machine 1 conducts processing relating to a BET selection by the player. More specifically, the CPU 51 in the station 3 accepts the BET selection. In response to the acceptance, the player conducts the BET selection through the touch panel 11. Then, the CPU 51 transmits selection information to the main control portion 40. The selection information is information relating to the BET selection by the player. When the player selects "call bet" as the BET selection, the CPU 51 conducts processing relating to call BET. Namely, the CPU 51 conducts processing for subtracting the value twice the value of the ante BET from the number of credits accumulated in the RAM 52 and determining this value as the value of call BET. The call BET is included in normal BET according to the present invention.

Next, in step S105, the gaming machine 1 determines whether or not the banker should fold. More specifically, the CPU 41 in the main control portion 40 determines whether or not the hand strength of the banker's cards is equal to or higher than the strength of "A-K-*-*-*". When determining that the hand strength of the banker's cards is equal to or higher than the strength of "AK-*-*-*", the gaming machine 1 shifts the processing to step S106. On the other hand, when determining that the hand strength of the banker's cards is lower than the strength of "A-K-*-*-*", the gaming machine 1 shifts the processing to step S109.

The processing conducted by the main control portion 40 in step S105 corresponds to step (c) determining whether or not the banker should fold, according to the present invention.

In the present embodiment, the standard for determining whether or not the banker should fold is related to the strength ranking of hands. However, in the present invention, it is not necessarily required to employ the strength ranking of hands as the standard for determining whether or not the banker should fold. For example, assigning the score to each card in advance, whether or not the banker should fold may be determined by determining whether or not the total score of the banker's cards exceeds a predetermined score. As described above, in the present invention, it is possible to set a predetermined value in certain quantitative variables as the standard for determining whether or not the banker should fold.

However, in the present invention, it is not necessarily required to relate the standard for determining whether or not the banker should fold, to quantitative variables. For example, it is possible to employ the structure, in which whether or not the banker should fold is determined based on whether or not a predetermined rank or suit is included in the banker's cards.

When determining that the hand strength of the banker's cards is equal to or higher than the strength of "A-K-*-*-*" (step S105: YES), the gaming machine 1 conducts processing for determining the result of the game (step S106). More specifically, the CPU 41 in the main control portion 40 determines winning or losing of the game by comparing the hand of the banker's cards with the hand of the player's cards based on the strength ranking of hands in poker.

The processing conducted by the main control portion 40 in step S106 corresponds to step (d) determining a result of a game by comparing a hand of the player's cards with a hand of the banker's cards, when determining that the banker should not fold in the step (c), according to the present invention.

Next, in step S107, the gaming machine 1 determines whether or not the result of the game determined in step S106 is winning of the player. When determining that the result of the game is a loss of the player, the gaming machine 1 ends the present subroutine. On the other hand, when determining that the result of the game is winning of the player (including a tie), the gaming machine 1 shifts the processing to step S108.

In step S108, the gaming machine 1 conducts processing relating to the payout.

More specifically, the CPU 41 in the main control portion 40 transmits ante-BET payout information and call BET payout information to the station 3. The ante BET payout information is information indicative of the value of a credit (currency value) to be paid out for the ante BET. The call-BET payout information is information indicative of the value of a credit (currency value) to be paid out for the call BET. More specifically, the CPU 41 transmits, as ante BET payout information, information indicative of the credit value twice the value of the ante BET. Further, the CPU 41 transmits, as call BET payout information, information indicative of the credit value resulting from the multiplication of the value of the call BET by the rate predetermined in accordance with the strength of hands. Further, when the result of the game determined in step S106 is a tie, the CPU 41 transmits information, as ante BET payout information, indicative of the same credit value as the value of the ante BET and transmits information, as call BET payout information, indicative of the same credit value as the value of the call BET.

On receiving the ante BET payout information and the call BET payout information transmitted from the CPU 41, the CPU 51 in the station 3 stores, in the RAM 52, credit data based on the ante BET payout information and the call BET payout information. Then, the CPU 51 pays out credits based on the ante BET payout information and the call BET payout information.

After conducting the processing in step S108, the gaming machine 1 ends the present subroutine.

When determining, in step S105, that the hand strength of the banker s cards is lower than the strength of "A-K-*-*-*" (step S105: NO), the gaming machine 1 determines whether or not the side BET has been inputted during the reception of the side BET in step S102 (step S109). When determining that no side BET is inputted, the gaming machine 1 shifts the processing to step S110. On the other hand, when determining that the side BET is inputted, the gaming machine 1 shifts the processing to step S111.

When determining, in step S109, that no side BET is inputted (step S109: NO), the gaming machine 1 conducts processing relating to the payout (step S110). More specifically, the CPU 41 in the main control portion 40 transmits, as ante BET payout information, information indicative of the credit value twice the value of the ante BET.

On receiving the ante BET payout information transmitted from the CPU 41, the CPU 51 in the station 3 stores, in the RAM 52, credit data based on the ante BET payout information. Then, the CPU 51 pays out the credit based on the ante BET payout information.

Further, as previously described, in step S110, different from step S108, no processing relating to the payout for the call BET is conducted. Namely, the CPU 41 transmits no call BET payout information to the station 3 and, also, the CPU 51 pays out no credits based on call BET payout information.

After conducting the processing in step S110, the gaming machine 1 ends the present subroutine.

When determining, in step S109, that a side BET is inputted (step S109: YES), the gaming machine 1 conducts processing for lowering the standard of the hand strength (the original standard) for determining whether or not the banker should fold (step S111). More specifically, the CPU 41 in the main control portion 40 selects a single hand out of the hands weaker than the strength of "A-K-*-*-*" using random numbers and determines this hand as the lowered standard.

The processing conducted by the main control portion 40 in steps S105, S109 and S111 corresponds to step (e) determining whether or not the banker should fold following a rule different from a rule in the step (c), on condition that the side BET is placed, when determining that the banker should fold in the step (c).

In the present embodiment, the original standard (the standard before being changed) and the lowered standard (the standard after changing) are values of the same variables, the strength ranking of hands. However, in the present invention, the standard before being changed and the standard after changing may be values of different variables. For example, the standard after changing may be determined in accordance with variables of the total score of cards.

For example, it is possible to employ a structure as follows. In this structure, assigning the score to each card in advance, whether or not the banker should fold may be determined by determining whether or not the total score of the banker's cards exceeds a predetermined score. For example, the score of the ace is counted as 1, the score of face card is counted as 10 and the scores of the other cards with ranks are counted as the scores corresponding to their own ranks. Further, when the total score of the banker's cards is less than 30 points, the banker should fold. In this structure, in the event that the banker's cards are cards as illustrated in FIG. 4, the banker should fold, when applying the rule in the step (c), but the banker should not fold, when applying the rule in the step (e). Namely, in the above-mentioned structure, there may be a case where the banker is caused to fold when applying the rule in the step (c), but the banker is not caused to fold when applying the rule in the step (e).

As described above, as the rule determined in the step (e), which is different from the rule in the step (c), it is possible to employ a rule such that the banker is not caused to fold when applying the rule in the step (e), even when the banker is caused to fold when applying the rule in the step (c).

Further, the rule determined in the step (e), which is different from the rule in the step (c), may be a rule such that whether or not the banker should fold is determined based on whether or not the banker's cards include a card having a predetermined rank or suit. For example, assuming that this rule is a rule such that the banker should fold when the banker's cards include a card having a rank of 8, and in the event that the banker's cards are cards as illustrated in FIG. 4, the banker should fold when applying the rule in the step (c), but the banker should not fold when applying the rule in the step (e).

Also, the rule determined in the step (e), which is different from the rule in the step (c), may be a rule such that the banker never folds and a game against the player is always executed.

When employing the structure described in the above-mentioned examples, there may be a case where the banker is not caused to fold when applying the rule in the step (e), even when the banker is caused to fold when applying the rule in the step (c). As the rule in the step (e) according to the present invention, it is possible to employ a rule as described above.

Next, in step S112, the gaming machine 1 determines whether or not the hand strength of the banker's cards is equal to or higher than the lowered standard determined in step S111. When determining that the hand strength of the banker's cards is lower than the lowered standard, the gaming machine 1 shifts the processing to step S113. On the other hand, when determining that the hand strength of the banker's cards is equal to or higher than the lowered standard, the gaming machine 1 shifts the processing to step S114.

When determining that the hand strength of the banker's cards is lower than the lowered standard in step S112, (step S112: No), the gaming machine 1 conducts processing relating to the payout (step S113).

More specifically, the CPU 41 in the main control portion 40 transmits side BET payout information to the station 3. The side BET payout information is information indicative of the value of the credit (currency value) to be paid out for the side BET. More specifically, the CPU 41 transmits information, as side BET payout information, indicative of a credit value twice the value of the side BET.

On receiving the side BET payout information transmitted from the CPU 41, the CPU 51 in the station 3 stores, in the RAM 52, credit data based on the side BET payout information. Then, the CPU 51 pays out a credit based on the side BET payout information.

After conducting the processing in step S113, the gaming machine 1 ends the present subroutine.

When determining that the hand strength of the banker's cards is equal to or higher than the lowered standard in step S112 (step S112: Yes), the gaming machine 1 conducts processing for determining the result of the game (step S114).

More specifically, the CPU 41 in the main control portion 40 determines winning or losing of the game by comparing the hand of the banker's cards with the hand of the player's cards, based on the strength ranking of hands in poker.

The processing conducted by the main control portion 40 in steps S112 and S114 corresponds to step (f) determining the result of the game by comparing the hand of the player's cards with the hand of the banker's cards, when determining the banker should not fold in the step (e), according to the present invention.

Next, in step S115, the gaming machine 1 determines whether or not the result of the game determined in step S114, is winning of the player. When determining that the result of the game is a loss of the player, the gaming machine 1 ends the present subroutine. On the other hand, when determining that the result of the game is winning of the player (including a tie), the gaming machine 1 shifts the processing to step S116.

In step S116, the gaming machine 1 conducts processing relating to the payout.

More specifically, the CPU 41 in the main control portion 40 transmits side BET payout information to the station 3. More specifically, the CPU 41 transmits information, as side BET payout information, indicative of the credit value resulting from the multiplication of the value of the side BET by the rate predetermined in accordance with the strength of the hand. Further, when the result of the game determined in step S114 is a tie, the CPU 41 transmits information, as side BET payout information, indicative of the same credit value as the value of the side BET.

On receiving the side BET payout information transmitted from the CPU 41, the CPU 51 in the station 3 stores, in the RAM 52, credit data based on the side BET payout information. Then, the CPU 51 pays out the credit based on the side BET payout information.

In the present embodiment, the resource for a payout relating to the side BET (the payouts in steps S113 and S116) is coins betted as the side BET. Namely, in the present embodiment, only when the banker folds in step S105, the payout relating to the side BET may be offered. Accordingly, when the banker does not fold in step S105, a payout relating to the side BET game is not offered and coins betted as the side BET are to be accumulated. The coins accumulated as described above form the resource for the payout relating to the side BET. However, in the present invention, the resource for the payout relating to the side BET is not limited to the case. It may be the same resource as the resource for the payout relating to the normal BET.

Further, even when determining, in step S105, that the hand strength of the banker's cards is lower than the strength of "A-K-*-*-*" and determining, in step S109, that no side BET is placed, the gaming machine 1 offers a payout based on the ante BET described in step S110 (not illustrated).

After conducting the processing in step S116, the gaming machine 1 ends the present subroutine.

There has been described the embodiment of the present invention.

While, in the present embodiment, there has been described a case where the card game is played using the gaming machine 1, the card game may be played without using a gaming machine (for example, a banker and a player play a game around an actual table) in the present invention.

Further, in the present embodiment, there has been described a case where a dealer serves as a banker. In the present invention, however, a single player may serve as a banker when a plurality of players takes part in the game.

Further, in the present embodiment, there has been described a case where CARIBBEAN STUD poker is played as a card game, a card game to be played in the present invention is not particularly limited. The numbers of player's cards and banker's cards are also changeable as appropriate.

Further, in the present embodiment, there has been described a case where playing cards are used to play a game. However, the cards (player's cards and banker's cards) according to the present invention are not limited to playing cards, but may be, for example, tarot cards.

Further, in the present embodiment, there has been described a case where players play CARIBBEAN STUD poker by viewing the main monitor 2 and the liquid crystal displays 10 included in the stations, the gaming machine according to the present invention is only required to include either a main monitor or liquid crystal displays (displays included in the stations). In the case of this structure, the dealer's cards (the banker's cards) and the player's cards may be displayed together to the main monitor or the displays in the stations.

Further, while in the present embodiment, there has been described a case where a side BET is placed before dealing cards to the player, the timing of placing the side BET is not limited thereto. For example, a side BET may be placed when conducting the BET selection, after dealing cards to the player.

Further, as a side BET according to the present invention, it is possible to employ a known side BET, such as "Progressive Jackpot" in CARIBBEAN STUD poker and "Insurance" in blackjack.

Although the present invention has been described with reference to embodiments thereof, these embodiments merely illustrate concrete examples, not restrict the present invention. The concrete structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there have been described processes to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processes described in the present specification are to be executed by various types of devices, in principle. Further, other structures required for conducting each step will be apparent from the aforementioned description.

What is claimed as new and desired to be secured by Letters Patent of the United States is:

1. A playing method of a card game executed by a processor of a gaming machine, comprising the steps of:

(a) dealing, by the processor, a predetermined number of cards to a player as player's cards and dealing, by the processor, a predetermined number of cards to a banker as banker's cards;

(b) placing, by the processor, a side BET different from a normal BET;

(c) determining, by the processor, whether or not the banker should fold;

(d) determining, by the processor, a result of a game by comparing a hand of said player's cards with a hand of said banker's cards, when determining that the banker should not fold in said step (c);

(e) determining, by the processor, whether or not the banker should fold following a rule different from a rule in said step (c), on condition that said side BET is placed, when determining that the banker should fold in said processing (c); and (f) determining, by the processor, the result of the game by comparing the hand of said player's cards with the hand of said banker's cards, when determining that the banker should not fold in said step (e).

2. The playing method of a card game according to claim 1, wherein said step (c) comprises the steps of:

(c-1) determining, by the processor whether or not the strength of said banker's cards is lower than a standard predetermined in an order of the hand strength; and (c-2) determining, by the processor that the banker should fold, when determining that the strength of said banker's cards is lower than said standard, and said step (e) comprises the steps of:

(e-1) lowering, by the processor said standard determined in said order of the hand strength, on condition that said side BET is placed, when determining that the banker should fold in said step (c);

(e-2) determining, by the processor whether or not the strength of said banker's cards is equal to or higher than said lowered standard;

(e-3) determining, by the processor that the banker should not fold, when determining that the strength of said banker's cards is equal to or higher than said lowered standard.

3. The playing method of a card game according to claim 1, comprising the steps of:

(a-1) placing, by the processor, an entry-fee BET before said step (a); and (c-3) offering, by the processor, a payout based on said inputted entry-fee BET, on condition that said side BET is not placed, when determining that the banker should fold in said step (c).

4. The playing method of a card game according to claim 1, further comprising the steps of:

(f-1) determining, by the processor, a payout based on said inputted side BET, when determining that the banker should fold in said step (e);

(f-2) determining, by the processor, a payout based on said inputted side BET and the result of the game, when the result of the game determined in said step (f) is winning of the player.

5. A gaming machine comprising:

a display capable of displaying a plurality of cards;

an input device; and a controller, said controller programmed to conduct the processing of:

(a) displaying a predetermined number of player's cards and a predetermined number of banker's cards to said display;

(b) accepting an input of a side BET different from a normal BET from said input device;

(c) determining whether or not the banker should fold;

(d) determining a result of a game by comparing a hand of said player's cards with a hand of said banker's cards, when determining that the banker should not fold in said processing (c);

(e) determining whether or not the banker should fold following a rule different from a rule in said processing (c), on condition that said side BET is placed, when determining that the banker should fold in said processing (c);

(f) determining the result of the game by comparing the hand of said player's cards with the hand of said banker's cards, when determining that the banker should not fold in said processing (e).

6. The gaming machine according to claim 5, wherein said processing (c) comprises the processing of:

(c-1) determining whether or not the strength of said banker's cards is lower than a standard predetermined in an order of the hand strength; and (c-2) determining that the banker should fold, when determining that the strength of said banker's cards is lower than said standard, and said processing (e) comprises processing of:

(e-1) lowering said standard determined in said order of the hand strength, on condition that said side BET is placed, when determining that the banker should fold in said processing (c);

(e-2) determining whether or not the strength of said banker's cards is equal to or higher than said lowered standard; and (e-3) determining that the banker should not fold, when determining that the strength of said banker's cards is equal to or higher than said lowered standard.

7. The gaming machine according to claim 5, wherein said controller is further programmed to conduct the processing of:

(a-1) accepting an input of an entry-fee BET from said input device before said processing (a); and (c-3) offering a payout based on said inputted entry-fee BET, on condition that said side BET is not placed, when determining that the banker should fold in said processing (c).

8. The gaming machine according to claim 5, wherein said controller is further programmed to conduct the processing of:

(f-1) determining a payout based on said inputted side BET, when determining that the banker should fold in said processing (e);

(f-2) determining a payout based on said inputted side BET and the result of the game, when the result of the game determined in said processing (f) is winning of the player.

* * * * *